US007748786B1

(12) United States Patent
Brower

(10) Patent No.: US 7,748,786 B1
(45) Date of Patent: Jul. 6, 2010

(54) FOOTREST

(75) Inventor: Paul Brower, Columbus, OH (US)

(73) Assignee: Sweetwood Homes LLC, Columbus, OH (US)

( * ) Notice: Subject to any disclaimer, the term of this patent is extended or adjusted under 35 U.S.C. 154(b) by 473 days.

(21) Appl. No.: 11/623,240

(22) Filed: Jan. 15, 2007

Related U.S. Application Data

(60) Provisional application No. 60/760,213, filed on Jan. 19, 2006.

(51) Int. Cl.
*A47C 16/02* (2006.01)

(52) U.S. Cl. ..... 297/423.41

(58) Field of Classification Search ..... 297/423.39, 297/423.41, 423.11, 423.14
See application file for complete search history.

(56) References Cited

U.S. PATENT DOCUMENTS

| | | | | | |
|---|---|---|---|---|---|
| 81,712 | A | | 9/1868 | Wagner | |
| 83,363 | A | | 10/1868 | Christian | |
| 165,498 | A | * | 7/1875 | Ott | 297/423.21 |
| 235,437 | A | | 12/1880 | Hopkins | |
| 259,883 | A | | 6/1882 | Mander | |
| 352,242 | A | | 11/1886 | Heine | |
| 393,169 | A | | 11/1888 | McGowan | |
| 503,246 | A | | 8/1893 | McQuillen | |
| 565,165 | A | | 8/1896 | Hall | |
| 590,268 | A | | 9/1897 | Lee | |
| 590,520 | A | | 9/1897 | Harte | |
| 682,234 | A | | 9/1901 | Bremser et al. | |
| 740,071 | A | | 9/1903 | Allen | |
| 778,074 | A | * | 12/1904 | Saffell | 297/423.22 |
| 878,521 | A | | 12/1907 | Earley | |
| 956,326 | A | | 4/1910 | Fitzsimons | |
| 967,452 | A | * | 8/1910 | Silverman | 297/188.11 |
| 1,026,179 | A | | 5/1912 | Regan | |
| 1,104,360 | A | | 7/1914 | Kusterer | |
| 1,114,153 | A | | 10/1914 | Laskowski | |
| 1,320,008 | A | | 10/1919 | Holwick | |
| 1,659,223 | A | | 2/1928 | Swanson | |
| 1,691,262 | A | | 11/1928 | Wurdack | |
| 1,738,810 | A | | 12/1929 | White | |
| 1,919,820 | A | | 7/1933 | Ashleman | |
| D92,703 | S | * | 7/1934 | Crego | D6/335 |
| 1,971,783 | A | | 8/1934 | Holloway | |
| 2,006,667 | A | | 7/1935 | Brown | |
| 2,024,170 | A | | 12/1935 | Kruse | |
| D103,575 | S | | 1/1937 | Janes | |
| 2,069,476 | A | * | 2/1937 | Keil | 280/32.5 |
| D109,239 | S | | 2/1938 | Wolpin | |
| 2,222,296 | A | | 11/1940 | Luiken | |
| 2,248,369 | A | * | 7/1941 | Ludersen | 248/371 |
| D139,504 | S | * | 11/1944 | Sadler | D6/349 |
| 2,414,856 | A | | 1/1947 | Cox | |
| 2,490,884 | A | | 12/1949 | Rau | |
| 2,508,109 | A | | 5/1950 | Glasco | |

(Continued)

OTHER PUBLICATIONS

Gilborn, Graig, Adirondack Furniture, Craftsman Style Furniture, Aug. 13, 2004, pp. 272-273.

(Continued)

*Primary Examiner*—Peter R. Brown
(74) *Attorney, Agent, or Firm*—Standley Law Group LLP

(57) ABSTRACT

A footrest is described, having a platform, a side rail and a plurality of surfaces for supporting one's feet.

20 Claims, 3 Drawing Sheets

U.S. PATENT DOCUMENTS

| | | | | | |
|---|---|---|---|---|---|
| 2,600,626 | A | | 6/1952 | Ellingson | |
| 2,650,652 | A | | 9/1953 | Watson | |
| 3,016,267 | A | | 1/1962 | Cones | |
| 3,032,634 | A | * | 5/1962 | Steinel et al. | 297/423.41 |
| 3,116,955 | A | * | 1/1964 | Siegal | 297/423.35 |
| 3,155,364 | A | | 11/1964 | Berg | |
| 3,301,596 | A | | 1/1967 | Eos | |
| 3,414,321 | A | | 12/1968 | Beck | |
| 3,650,562 | A | | 3/1972 | Adler | |
| 3,736,023 | A | | 5/1973 | Lyons | |
| 3,902,758 | A | | 9/1975 | Pivacek | |
| 3,993,003 | A | | 11/1976 | James | |
| 4,059,305 | A | | 11/1977 | Ammirata | |
| 4,109,961 | A | | 8/1978 | Opsvik | |
| 4,290,502 | A | | 9/1981 | Anderson | |
| 4,328,991 | A | | 5/1982 | Mengshoel et al. | |
| 4,348,051 | A | | 9/1982 | Boucher | |
| 4,377,309 | A | | 3/1983 | Mengshoel | |
| 4,383,488 | A | | 5/1983 | Mach et al. | |
| 4,392,685 | A | | 7/1983 | Leonhart | |
| 4,462,636 | A | | 7/1984 | Markson | |
| D277,722 | S | | 2/1985 | Gusrud | |
| 4,534,590 | A | * | 8/1985 | Yamamura et al. | 297/180.12 |
| 4,536,032 | A | | 8/1985 | Highberger | |
| 4,635,998 | A | | 1/1987 | Hickey | |
| 4,664,039 | A | | 5/1987 | Schneider | |
| 4,707,023 | A | | 11/1987 | Hickey | |
| D295,927 | S | | 5/1988 | Hickey | |
| 4,753,320 | A | | 6/1988 | Walter | |
| 4,792,181 | A | | 12/1988 | Guichon | |
| D305,081 | S | | 12/1989 | Grosfillex | |
| 4,901,385 | A | * | 2/1990 | Adolphson | 297/423.45 |
| 4,991,908 | A | | 2/1991 | Krechel | |
| D319,354 | S | | 8/1991 | Wolcott | |
| 5,098,160 | A | | 3/1992 | Moore et al. | |
| 5,120,071 | A | | 6/1992 | Thibault et al. | |
| 5,244,255 | A | | 9/1993 | Hill | |
| D350,860 | S | | 9/1994 | Greeson | |
| D351,739 | S | | 10/1994 | Cannon | |
| 5,419,618 | A | * | 5/1995 | Hatcher | 297/423.46 |
| 5,449,222 | A | | 9/1995 | Titchener et al. | |
| 5,489,144 | A | | 2/1996 | Lewis | |
| D371,466 | S | | 7/1996 | Boisson | |
| D372,803 | S | | 8/1996 | Tucker | |
| 5,556,167 | A | | 9/1996 | Johnson Siemion | |
| 5,584,535 | A | * | 12/1996 | Jacobson et al. | 297/423.46 |
| 5,593,212 | A | | 1/1997 | Praria et al. | |
| 5,597,199 | A | | 1/1997 | Hoffman et al. | |
| D396,151 | S | | 7/1998 | Magee | |
| D398,785 | S | | 9/1998 | Pogue et al. | |
| D409,849 | S | | 5/1999 | Tseng | |
| 6,045,192 | A | | 4/2000 | Faulise | |
| 6,065,807 | A | | 5/2000 | Going et al. | |
| 6,145,931 | A | | 11/2000 | Subotic | |
| 6,257,660 | B1 | | 7/2001 | Calvey | |
| D446,399 | S | | 8/2001 | Slear | |
| 6,283,546 | B1 | | 9/2001 | Hill | |
| 6,299,251 | B1 | | 10/2001 | Harper | |
| 6,382,727 | B1 | | 5/2002 | Pickard | |
| D460,566 | S | | 7/2002 | Henschel et al. | |
| 6,425,457 | B1 | | 7/2002 | Lundry | |
| D468,916 | S | | 1/2003 | Pomeroy et al. | |
| 6,527,327 | B2 | | 3/2003 | Gaus et al. | |
| 6,659,224 | B2 | | 12/2003 | Medsker | |
| D484,714 | S | | 1/2004 | Que | |
| 2002/0060491 | A1 | | 5/2002 | Kneier | |
| 2003/0038522 | A1 | | 2/2003 | Bergeron et al. | |
| 2003/0047979 | A1 | * | 3/2003 | Carom | 297/423.45 |

OTHER PUBLICATIONS

Gilborn, Graig, Adirondack Furniture, Craftsman Style Furniture, Aug. 13, 2004, pp. 275-284.

Classic Adirondacks, Great value, great price $159.95-$199.95.

Beeken, Bruce, and Parsons, Jeff, Adirondacks Chairs: A fresh look at an old favorite, Fine Woodworking, May/Jun. 1985, pp. 46-49.

Rademacher, Tom, College kids set out to build a better chair, Region, The Grand Rapid Press, Jul. 17, 2005, Section B1-2, Michigan.

Gloag, John, The Chair: It's Origins, Design and Social History, 1967, 2 pages, A.S. Barnes and Company, South Brunswick and New York.

P.R. Rincones, Jr. Company, Advertisement, no date, New York.

* cited by examiner

FOOTREST

This application claims the priority benefit of U.S. Provisional Patent Application No. 60/760,213, filed Jan. 19, 2006, which is hereby incorporated by reference in its entirety.

BACKGROUND AND SUMMARY OF THE INVENTION

The exemplary embodiments are directed to indoor and outdoor furniture and in particular to a footrest with multiple surfaces adapted to support a user's feet.

Today, most devices sold or produced in the category of "footrest" may be more appropriately considered "leg rests". For outdoor furniture, such as Adirondack furniture, the user's legs rather than feet may rest against the surface used for the purpose of keeping one's feet off the ground. With regard to indoor furniture, ottomans and reclining furniture also have a surface for the user to rest his or her legs thereupon. Resting legs on a flat surface may cause pressure on the calves or strain the knees. This may create problems with many individuals including the elderly or those with poor circulation or diabetes.

Many chairs sold today may be inconvenient for persons of short stature. Whether basic, adjusting, tilting, rocking and/or reclining, they may still be too high off the ground for a person of short stature to be able to effectively touch the ground to adjust position, rock and/or tilt the chair. Not only may the person not be able to touch the ground but the chair may put pressure on the back of the user's knees, causing discomfort. In order to alleviate this pressure, a user may sit forward in the chair; however, this may be just as uncomfortable due to a lack of back support. These chair designs may lack a surface from which a user may push off from. This may restrict movement.

Other chairs having built-in footrests may be wider than the user's straddling width. Because of this, the user may be unable to straddle the footrest to enter the chair. This may require the user to sit on the footrest, swing his or her legs over the footrest and then scoot into the seat of the chair. This problem may also affect persons of short stature.

Many standalone footrests are also known. Many standalone footrests may move, slide or tip when pressure is applied to its surfaces. Many times the user may want to readjust his or her position in the chair and pushes on the footrest to do so. If the footrest moves, slides or tips then the readjustment may fail. Other footrests may have one static position, which may discourage movement. Prolonged static sitting may cause back and/or body pain. Moving while sitting may help to alleviate these problems. Posture variety and/or position changes may also help.

Exemplary embodiments may attempt to overcome or solve many of these problems associated with known footrests. The exemplary embodiments are directed to a footrest which may have a platform, a side rail and a foot rail. A user may place his or her feet on multiple surfaces of the footrest. The footrest may have multiple levels and multiple planes. This encourages movement, posture variety, and/or position change while sitting.

BRIEF DESCRIPTION OF THE DRAWINGS

In addition to the features mentioned above, other aspects of the exemplary embodiments will be readily apparent from the following descriptions of the drawings, wherein like reference numerals across the several views refer to identical or equivalent features, and wherein.

DETAILED DESCRIPTION OF THE EXEMPLARY EMBODIMENT(S)

Figure 1:
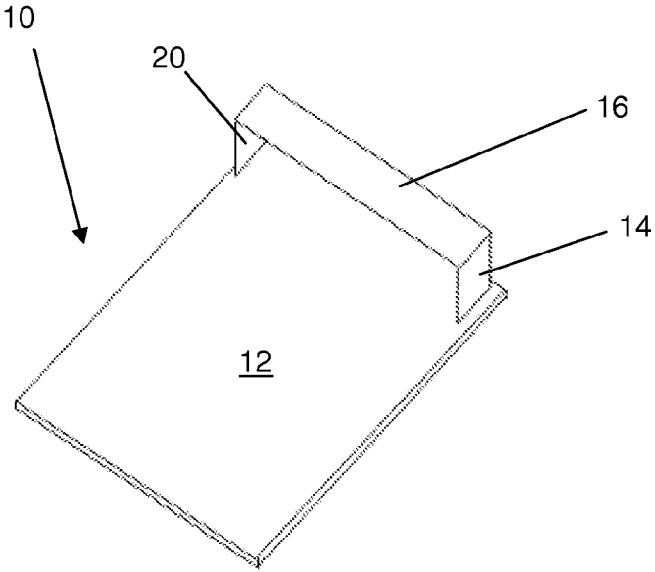
FIG. 1 illustrates a perspective view of one exemplary embodiment of a footrest.

FIG. 1 illustrates one exemplary embodiment of a footrest 10. The footrest 10 may include a platform 12, a side rail 14 and a foot rail 16. The foot rail 16 may extend from the side rail 14 which may extend from the platform 12. Footrest 10 may also include an additional foot rail 18. Any number of foot rails may be used. Each foot rail may also be at different levels and/or on different planes. Each foot rail may have similar or different angles. The foot rails may be horizontal, vertical or may be positioned at any angle. In one exemplary embodiment, the foot rail and/or foot rails may have an angle θ between about 10 and about 60 degrees. In another exemplary embodiment, angle θ may be about 36 degrees. The foot rails may have any length or width as will be understood by one of ordinary skill in the art. The foot rails may extend beyond the width of the platform 12 or through the side rails 14 and/or 20.

Figure 2:
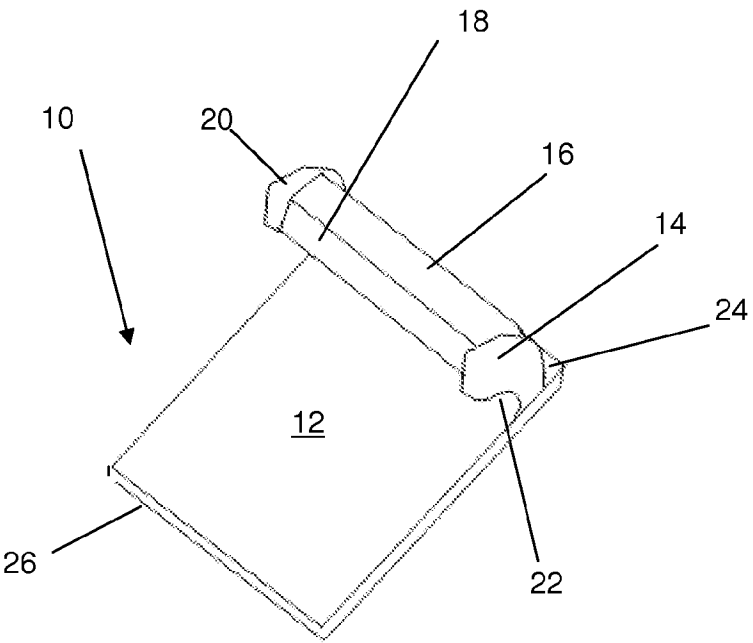
FIG. 2 illustrates a perspective view of another exemplary embodiment of a footrest.

As shown in FIG. 2, the side rails 14 and 20 may be made of any width or height. This allows for incorporation of multiple foot rails. The entire side rails or portions of the side rails may extend partially or completely along the sides of the platform 12. Multiple side rails may be used. The side rails may also be any shape such as but not limited to, a circle, square, rectangle, polygon, swirl and/or shell. The side rails may also include a cutout 22 that may allow a user's feet to pass side to side from over the platform 12 to outside the platform 12 without hitting the side rails 14, 20. The cutout 22 may be any size and/or shape. The side rails may extend vertically above the foot rails or may be level with the foot rails.

Figure 3:
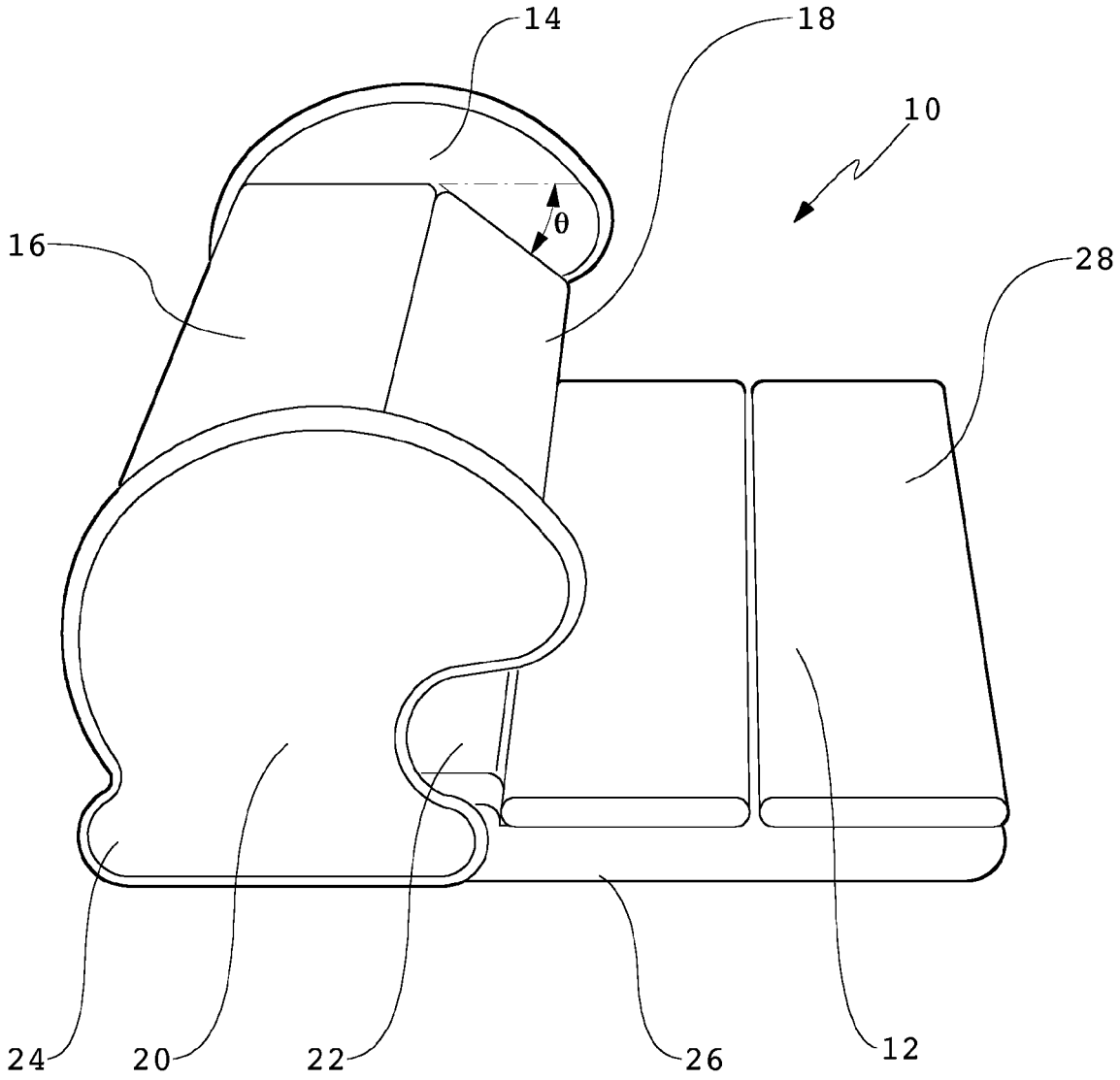
FIG. 3 illustrates a perspective view of yet another exemplary embodiment of a footrest.

The platform 12 may be any length or width that may allow a user to place his or her feet on any of the available surfaces of the footrest 10. The platform 12 may be substantially parallel to and supported by a subjacent surface. The surface may be any surface, such as but not limited to, the ground, patio and/or deck if used outdoors or the floor if used indoors. The platform 12 may have a predetermined thickness which may allow a user an additional level or plane on which to place his or her feet. The platform 12 may assist in preventing footrest 10 from tipping when pressure is applied to the footrest 10. The platform 12 may also include a toe 24 at the front of the footrest 10. The toe 24 may assist in preventing the footrest 10 from tipping. The toe 24 may be of any size, shape and/or number. The platform 12 may include a non-skid surface 26 on the bottom of the platform 12. The non-skid surface 26 may be an adhesive, rubber and/or grit and may be applied to a portion or the entire bottom of the footrest 10. The non-skid surface 26 assists in preventing the footrest 10 from moving when pressure is applied, for example when rocking or shifting position. The platform 12 or the footrest 10 may also be of a sufficient weight to prevent the footrest 10 from moving. In one exemplary embodiment, as shown in FIG. 3, the footrest 10 may include planks 28.

The footrest 10 may be designed to allow a user to move while sitting. A user of the footrest 10 may place his or her feet upon the platform 12, side rails 14, 20 and/or foot rails 16, 18. This may allow a user multiple levels, planes and/or positions on which to place his or her feet. The footrest 10 may encourage a user to move into a variety of positions. The footrest 10 may also encourage posture variety which may help avoid prolonged static sitting.

The footrest 10, any individual components of the footrest 10 or any combination of individual components of the footrest 10 may be formed from a single integral piece of material or from multiple pieces connected together. The pieces or components can be connected by any method known in the art. For example, nails, screws, pins, tacks, clamps, cables, hooks, latches, hinges, rivets, tongue and groove, dowels, adhesives, welding and/or any combination thereof may be used. The footrest 10 and/or its components may be made from any material. For example, the footrest 10 and/or its components may be made from wood (either hard or soft), treated wood, wood/plastic composite, plastic, concrete, stone, resin, metal, such as but not limited to cast iron, wrought iron, steel or aluminum, and/or any combination thereof. The footrest 10 may be made from one material and covered wholly or partially in another. Multiple layers of material may be used. In one exemplary embodiment, footrest 10 may be made from wood, covered in a cushioning material and covered again in a leather or cloth material. The footrest 10 may be made of a single solid component. The footrest 10 may also be made of multiple solid components and/or hollow components such as but not limited to metal tubing. The footrest 10 may be standalone or may be incorporated into any piece of furniture. The footrest 10 may also be incorporated into permanent structures such as park benches.

During use, a user may place his or her feet in multiple positions and/or locations on the footrest 10. For example, a user may place the footrest 10 in front of a chair. The user may then stand on the platform 12 and sit in the chair. The user may also straddle the footrest 10 and sit in the chair. The footrest 10 may be designed to allow a user to easily straddle the footrest to sit in a chair. Once seated, the user may place his or her feet on any surface of the footrest 10. The multiple surfaces provide the user multiple levels and/or planes on which to place his or her feet. For example, a user may place his or her feet on the platform 12 at one level, on one foot rail 16 at another level, on a second foot rail 18 at another level or on the side rail 14 at another level.

With the footrest 10, a user may remove his or her shoes and may place his or her shoes on the footrest 10 for storage. The user may then use the footrest 10 to assist in donning his or her shoes again. The footrest 10 may also be designed in such a way that movement may be encouraged. Movement while sitting may help combat lower back pain. Having multiple levels and/or planes on which to place one's feet offers posture variety. Posture, position, elevation and location variety may encourage movement and may discourage prolonged static sitting. A user may also push off the footrest 10 while rocking or shifting positions in a chair. The toe 24 on the platform 12 may prevent tipping of the footrest 10 while the non-skid surface 26 or the weight of the footrest 10 may prevent the footrest 10 from moving when pressure is applied. The footrest 10 may remain stationary while the user and/or chair move.

Figure 4:
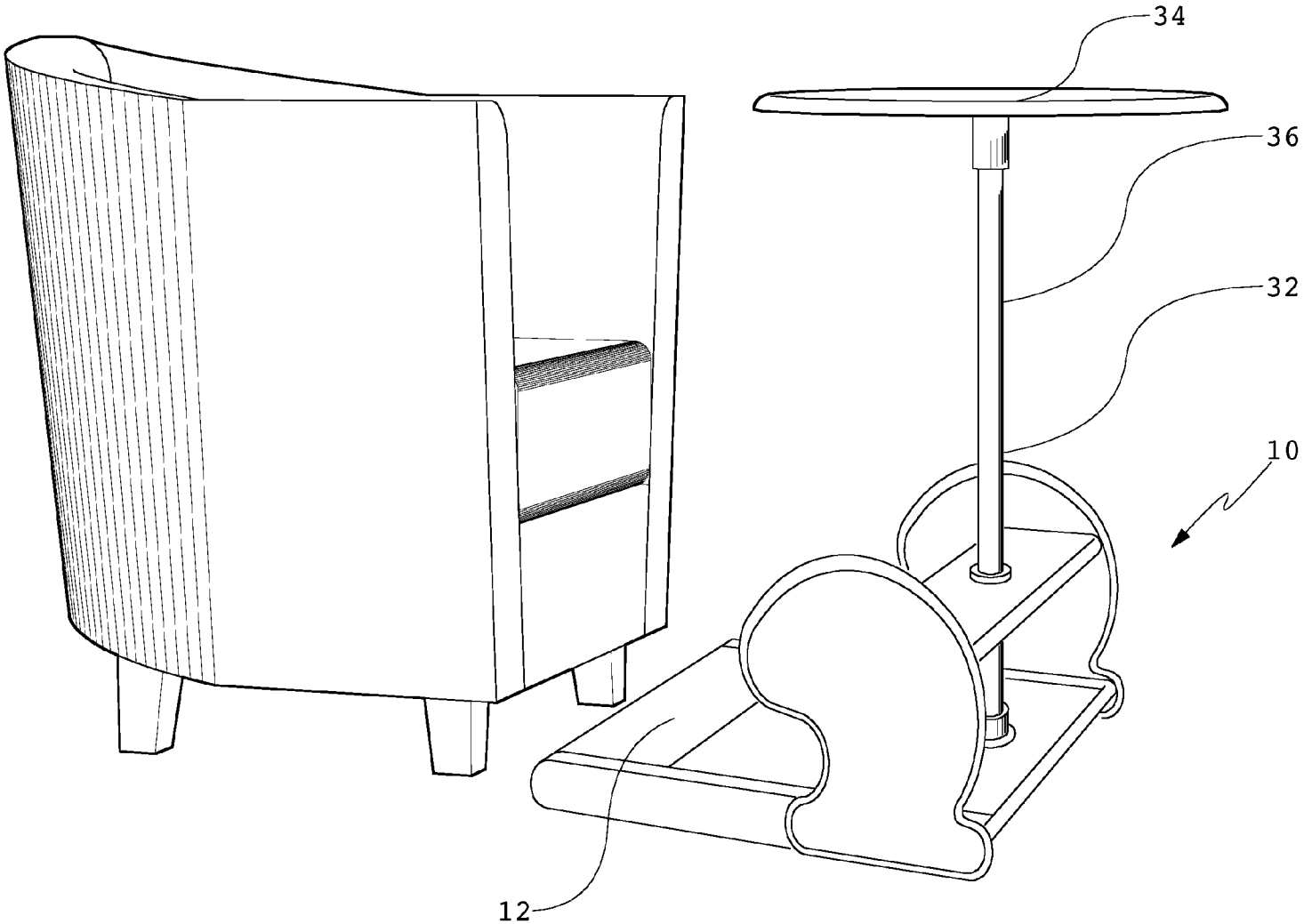
FIG. 4 illustrates a perspective view of another exemplary embodiment of a footrest with a telescoping table in a first position.

FIG. 4 illustrates another exemplary embodiment of a footrest 10 with additional features. The footrest 10 may include a support 32 which may be attached to the footrest 10 in any manner known in the art. A table 34 may be attached to the support 32. The table 34 may be attached to the support 32 in any manner known in the art. The table 34 may be any size or shape. The table 34 may be attached to the support 32 at the center of the table 34 or may be offset to any side. For example, the table 34 may attach to the support 32 at the rear of the table 34 so that most of the table 34 is above the platform 12. The support 32 may also include an adjustment member 36. The adjustment member 36 may allow the table 34 to be raised and lowered along the support 32. In one exemplary embodiment, a thumbscrew may be used as the adjustment member 36. In such an exemplary embodiment, the thumbscrew may be loosened, the table may be raised or lowered and then the thumbscrew tightened again to position the table in place. The adjustment member may be any adjustment member known in the art.

A wide variety of components may be used with the footrests and supports in this fashion. For example, any of the exemplary embodiments could also include, pedestal tables, umbrella stands, pedestal tables with umbrellas, picnic tables, conversation tables, hammock stands, fire rings, firepits, & chiminea surrounds, light poles, lantern poles, citronella poles, torch or tiki poles, chinese lanterns, candle holders, gazebo poles, reading or book stands, deck & book railings, porch swing stands, bird feeders, hummingbird feeders, bird houses, bird baths, fountain poles, sprinklers, misting fans, plant stands & hooks, plant pots/urns, lawn globe stands, rain gauges, sun dials, cascading petunias displays, string or wire trellis, garden entrance, arbors, tree surrounds, garden surrounds, campfire rings, council rings, & story rings, cooking arms & hooks, flag poles, tent poles, canopy frames, dining tarp frames, patrol flags, totem poles—group or individual, may poles, standard bearer poles, banner stone poles, water stations, bike racks, doggie zip lines, clock towers, stationary binoculars, market umbrellas, outdoor vendor stations, display signs, merchant signs, trade signs, clothesline poles, signage, music stands, art easel stands, conductor's stand, microphone stands, kinetic art or wind art stands, statuary, weather vanes, windsocks, wind dancers, wind chimes, sports nets or poles, such as, racquetball, tennis, tetherball etc., computer desks and workstations, laptop computer workstations, office desks, reading stands, book stands, pedestal tables, drop front desks, partners desks, trestle desks, trestle library tables, coffee tables, lamp stands, window benches, perches, bookcases, magazine racks, drafting tables, TV dinner trays, dining room tables, drop leaf tables, trestle tables, bed step ups, shoe helpers by bed, night stands, dressers, kneeling benches and/or other indoor/outdoor products.

While certain exemplary embodiments are described in detail above, the scope of the invention is not to be considered limited by such disclosure, and modifications are possible without departing from the spirit of the invention as evidenced by the following claims:

What is claimed is:

1. A footrest for supporting the soles of the feet of a user comprising:

a substantially horizontal stationary platform adapted for placement on a subjacent surface and supporting the weight of the user, the platform having a first pair of opposing side edges and a second pair of opposing edges;

first and second side rails extending along the first pair of opposing side edges of the platform and substantially vertically from said platform and ceasing at an upmost peak, where the length of the side rails are less than three-fourths the length of the first pair of opposing side edges of the platform;

a first foot rail extending between said first and second side rails and vertically located below the upmost peak of the side rails; and a second foot rail extending between said first and second side rails, said second foot rail placed immediately adjacent to the first foot rail and disposed at an angle from said first foot rail;

where the weight of the platform, side rails, and foot rails is sufficient to resist sliding and tipping when the user applies forces with the soles of the feet.

2. The footrest from claim 1 wherein:

the first foot rail provides a substantially horizontal surface.

3. The footrest from claim 1 further comprising:

a toe connected to one of the second pair of opposing edges of the platform, the toe being placed on the opposite side of the side rails relative to the user and adapted to prevent the footrest from tipping when the user applies forces with the soles of the feet.

4. The footrest of claim 1 wherein:

the second foot rail is disposed at 25-45 degrees from horizontal.

5. The footrest of claim 1 wherein:

the upmost peaks of the first and second side rails are rounded.

6. The footrest of claim 1 wherein:

the horizontal platform, first foot rail, and second foot rail are fixed relative to one another.

7. A footrest for facilitating multiple leg positions of a user within a chair, the footrest comprising:

a stationary horizontal platform having a first pair of opposing side edges and a second pair of opposing edges, the platform providing a first surface for the user to rest their feet;

first and second side rails extending along the first pair of opposing side edges of the platform and substantially vertically from said platform and ceasing at an upmost peak, where the lengths of the side rails are less than three-fourths the length of the first pair of opposing side edges of the platform and the upmost peaks of the side rails provide a second and third surface for the user to rest their feet;

a first foot rail extending between said first and second side rails and vertically located below the upmost peak of the side rails and providing a substantially horizontal surface adapted to allow a user to stand upon and providing a fourth surface for the user to rest their feet;

a second foot rail extending between said first and second side rails and placed immediately adjacent to the first foot rail, said second foot rail disposed at an angle from said first foot rail and providing a fifth surface for the user to rest their feet; and a toe attached to said platform and placed on the opposite side of the side rails relative to the user and adapted to prevent the footrest from tipping if the user stands on the first foot rail.

8. The footrest of claim 7 wherein:

the platform, toe, first side rail, second side rail, first foot rail and second foot rail are constructed of wood.

9. The footrest of claim 7 wherein:

the platform, toe, first side rail, second side rail, first foot rail and second foot rail are constructed of concrete.

10. The footrest of claim 7 wherein:

the lengths of the side rails are less than half the length of the first pair of opposing side edges of the platform.

11. The footrest of claim 7 wherein:

the second foot rail is disposed at 25-45 degrees from horizontal.

12. The footrest of claim 7 wherein:

cutouts on the first and second side rails which remove material from the side rails between the second foot rail and the platform to allow the user to slide their feet horizontally underneath the second foot rail.

13. The footrest of claim 7 wherein:

the horizontal platform, first foot rail, and second foot rail are fixed relative to one another.

14. The footrest of claim 7 further comprising:

a vertical support passing through the first foot rail and attached to the platform.

15. The footrest of claim 14 further comprising:

a table attached to the vertical support.

16. The footrest of claim 15 wherein:

the vertical support is adjustable to locate the table at a plurality of different heights.

17. A device for facilitating multiple leg positions of a user within a chair and providing a raised surfaces for standing, the device comprising:

a substantially horizontal stationary platform having a first pair of opposing side edges and a second pair of opposing edges, the platform adapted to support the weight of the user;

first and second side rails extending along the first pair of opposing side edges of the platform and substantially vertically from said platform and ceasing at an upmost peak, where the lengths of the side rails are less than three-fourths the length of the first pair of opposing side edges of the platform;

a horizontal foot rail, the foot rail extending between said first and second side rails and vertically located below the upmost peak of the side rails, the horizontal foot rail having an edge closest to the user and adapted to support the weight of the user;

a sloping foot rail extending from the edge of the horizontal foot rail closest to the user and sloping downward towards the user between 20 and 45 degrees from horizontal; and a toe attached to said platform and placed on the opposite side of the side rails relative to the user and adapted to prevent the footrest from tipping when the user applies forces with the soles of the feet.

18. The device of claim 17 wherein:

the horizontal platform, horizontal foot rail, and sloping foot rail are fixed relative to one another.

19. The device of claim 17 further comprising:

cutouts on the first and second side rails which remove material from the side rails between the second foot rail and the platform to allow the user to slide their feet horizontally underneath the second foot rail.

20. The device of claim 17 wherein:

the horizontal platform, first and second side rails, horizontal foot rail, sloping foot rail, and toe are composed of concrete.

* * * * *